US012727615B2

(12) United States Patent
Jeoung

(10) Patent No.: US 12,727,615 B2
(45) Date of Patent: Sep. 8, 2026

(54) COMBUSTIBLE HEAT SOURCE FOR SMOKING ARTICLE AND SMOKING ARTICLE COMPRISING SAME

(71) Applicant: KT&G CORPORATION, Daejeon (KR)

(72) Inventor: Eunmi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 428 days.

(21) Appl. No.: 18/032,584

(22) PCT Filed: Nov. 28, 2022

(86) PCT No.: PCT/KR2022/018985

§ 371 (c)(1),
(2) Date: Apr. 19, 2023

(87) PCT Pub. No.: WO2023/121025

PCT Pub. Date: Jun. 29, 2023

(65) Prior Publication Data

US 2024/0373908 A1 Nov. 14, 2024

(30) Foreign Application Priority Data

Dec. 23, 2021 (KR) ..... 10-2021-0186235

(51) Int. Cl.
*A24D 1/22* (2020.01)
*A24B 15/16* (2020.01)

(52) U.S. Cl.
CPC ..... *A24D 1/22* (2020.01); *A24B 15/165* (2013.01)

(58) Field of Classification Search
None
See application file for complete search history.

(56) References Cited

U.S. PATENT DOCUMENTS

2005/0000150 A1* 1/2005 Appleby ..... C10L 9/10 44/385

FOREIGN PATENT DOCUMENTS

| | | | | |
|---|---|---|---|---|
| CN | 104602554 A | | 5/2015 | |
| CN | 108991590 A | * | 12/2018 | ..... A24B 15/30 |
| EP | 0174645 A2 | | 3/1986 | |
| EP | 0 337 508 A2 | | 10/1989 | |
| JP | 2-86759 A | | 3/1990 | |
| JP | WO2007/119678 A1 | | 10/2007 | |
| KR | 10-1996-0005615 B1 | | 4/1996 | |
| KR | 10-0558809 B1 | | 3/2006 | |

(Continued)

OTHER PUBLICATIONS

European Search Report dated Mar. 15, 2024 in Application No. 22893952.6.

(Continued)

*Primary Examiner* — Phu H Nguyen
(74) *Attorney, Agent, or Firm* — Sughrue Mion, PLLC

(57) ABSTRACT

The present disclosure provides a combustible heat source composition for a smoking article, that does not contain a binder and a combustion inhibitor, wherein the composition comprises 1 to 5 parts by weight of a polyhydric alcohol based on 100 parts by weight of the solid content. A smoking article to which a combustible heat source composed of the composition is applied is characterized by having excellent ignitability and combustibility.

8 Claims, 2 Drawing Sheets

| Sample conditions | Moisture application | Glycerin | Propylene glycol |
|---|---|---|---|
| Combustion image |  |  |  |
| Combustion phenomenon | Ignition takes 40s/Late combustion time | Ignition takes 25s / A large amount of smoke is generated during combustion<br>Generation of burning charcoal-like off-flavor<br>Flames are generated on the surface during combustion, and glycerin flows out of the combustion body after combustion | Ignition takes 25s/Combustion is good/Small amounts of smoke and flame are generated during combustion/Combustion is good on the whole |

(56) References Cited

FOREIGN PATENT DOCUMENTS

| | | | |
|---|---|---|---|
| KR | 10-2008-0098433 | A | 11/2008 |
| KR | 10-1120240 | B1 | 3/2012 |
| KR | 10-2018-0051484 | A | 5/2018 |
| KR | 10-2019-0086580 | A | 7/2019 |
| KR | 10-2020-0030364 | A | 3/2020 |
| KR | 10-2220688 | B1 | 2/2021 |
| WO | 2020/202528 | A1 | 10/2020 |

OTHER PUBLICATIONS

International Search Report of PCT/KR2022/018985 dated Feb. 21, 2023 [PCT/ISA/210].

Office Action issued Jul. 2, 2024 in Japanese Application No. 2023-531044.

Communication dated Nov. 25, 2025 issued by the State Intellectual Property Office of the P.R.China in application No. 202280008377.4.

Zhou Jianbin, et al., "Preparation and combustion properties of inflammable carbon from poplar carbon", Transactions of the CSAE, 2010, vol. 26, No. 6, pp. 257-261 (5 pages total).

Communication dated Apr. 22, 2026, issued in Chinese Application No. 202280008377.4.

* cited by examiner

| Sample conditions | Moisture application | Glycerin | Propylene glycol |
|---|---|---|---|
| Combustion image | 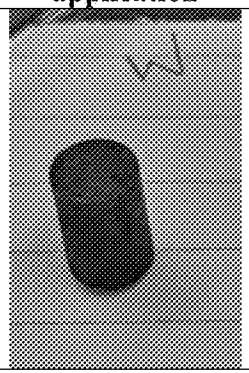 | 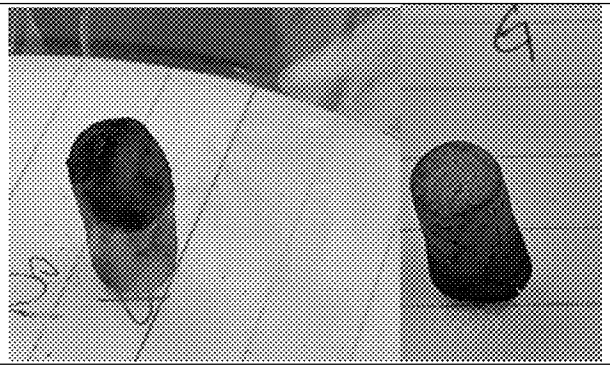 | 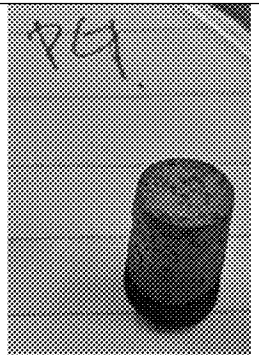 |
| Combustion phenomenon | Ignition takes 40s/Late combustion time | Ignition takes 25s / A large amount of smoke is generated during combustion<br>Generation of burning charcoal-like off-flavor<br>Flames are generated on the surface during combustion, and glycerin flows out of the combustion body after combustion | Ignition takes 25s/Combustion is good/Small amounts of smoke and flame are generated during combustion/Combustion is good on the whole |

FIG. 1

COMBUSTIBLE HEAT SOURCE FOR SMOKING ARTICLE AND SMOKING ARTICLE COMPRISING SAME

CROSS REFERENCE TO RELATED APPLICATIONS

This application is a National Stage of International Application No. PCT/KR2022/018985, filed Nov. 28, 2022, claiming priority to Korean Patent Application No. 10-2021-0186235, filed Dec. 23, 2021.

TECHNICAL FIELD

The following description relates to a combustible heat source for a smoking article, and a smoking article comprising the same.

BACKGROUND ART

A number of smoking articles which are heated rather than combusted have recently been proposed. Unlike conventional smoking articles, these non-combustion type smoking articles are used by sucking an aerosol generated by heating the smoking article medium without burning the smoking article medium. As one of these types of heating-type smoking articles, there is a smoking article product to which a carbon heat source is applied.

A smoking article to which the carbon heat source is applied generates an aerosol by heat transfer from the carbon heat source to a smoking article medium located downstream of the carbon heat source.

The smoking article product to which the carbon heat source is applied has a smoking form similar to that of a traditional smoking article, unlike general heating-type electronic smoking articles using a dedicated device, so that consumers' smoking convenience and satisfaction can be expected to be improved.

RELATED ART DOCUMENT

Patent Document (Patent Document 1) Korean Patent Publication No. 2020-0030364

DISCLOSURE OF THE INVENTION

Technical Goals

An object of the present disclosure is to provide a combustible heat source having excellent ignitability and combustion persistency, and a smoking article comprising the heat source.

Technical Solutions

The present disclosure provides a combustible heat source composition for a smoking article, that does not contain a binder and a combustion inhibitor, wherein the composition comprises 1 to 5 parts by weight of a polyhydric alcohol based on 100 parts by weight of the solid content.

In one embodiment of the present disclosure, the binder may be one or more selected from the group consisting of carboxymethylcellulose, ammonium alginate, pectin, carrageenan, and guar gum.

In another embodiment of the present disclosure, the combustion inhibitor may be calcium carbonate.

In yet another embodiment of the present disclosure, the polyhydric alcohol may be contained in an amount of 1 to 3 parts by weight.

In still another embodiment of the present disclosure, the polyhydric alcohol may be glycerin or propylene glycol.

In yet still another embodiment of the present disclosure, the polyhydric alcohol may be propylene glycol.

In a further embodiment of the present disclosure, the heat source may be ignited within 30 seconds, and combustion may continue for 140 seconds or more.

Furthermore, the present disclosure provides a smoking article comprising a combustible heat source composed of the composition.

Effects

The conventional combustible heat source has had a limitation in that ignition and stable combustion persistence are not easy by using charcoal as the main component. Accordingly, the present disclosure is characterized by using a polyhydric alcohol to facilitate ignition of a combustible heat source and improve moldability of the heat source to improve combustion persistency, and the heat source composed of the composition according to the present disclosure has improved ignitability and combustibility compared to conventional heat sources.

BRIEF DESCRIPTION OF DRAWINGS

FIG. 1 is a view showing combustion results of combustible heat sources manufactured in Embodiments of the present disclosure.

BEST MODE FOR CARRYING OUT THE INVENTION

Figure 2:
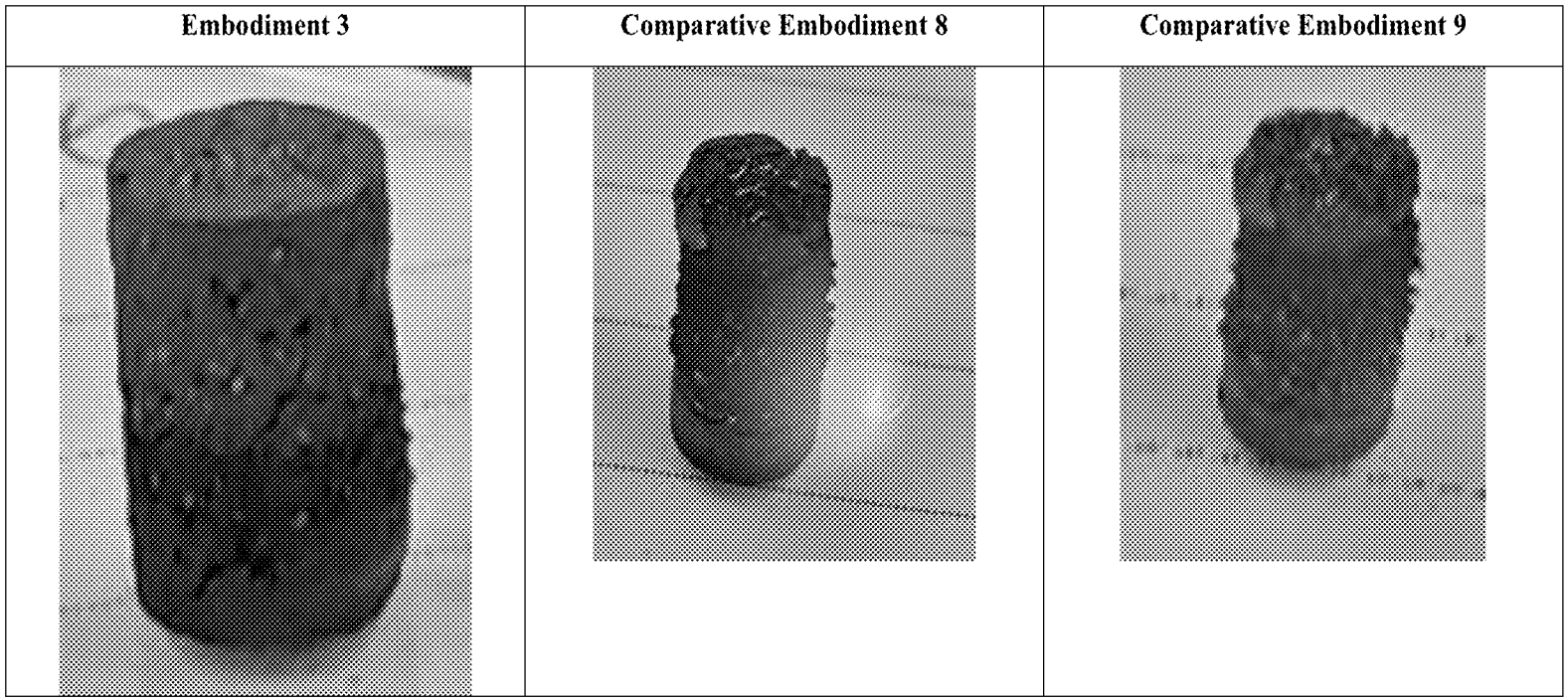
FIG. 2 is a view showing results of checking the external appearances of heat sources during combustion in Embodiments of the present disclosure.

Hereinafter, the present disclosure will be described in detail so that those skilled in the art to which the present disclosure pertains can easily carry out the present disclosure. However, the present disclosure may be embodied in many different forms and is not limited to the content described herein.

Throughout the specification, "lengthwise direction of a smoking article comprising a combustible heat source" means a direction in which the length of the smoking article comprising a combustible heat source extends or a direction in which combustion proceeds when the smoking article comprising a combustible heat source is combusted.

Throughout the specification, in the terms "upstream" and "downstream", a part where air enters from the outside to the inside of the smoking article comprising a combustible heat source when the user sucks in outside air using a smoking article comprising a combustible heat source is an "upstream", and a portion where air exits from the inside to the outside of the smoking article comprising a combustible heat source is a "downstream". The terms "upstream" and "downstream" may be used to indicate the relative position or direction between parts that make up the smoking article comprising the combustible heat source.

Demand for heating-type electronic smoking articles is increasing. Most heating-type electronic smoking articles have a device in the structure of [device+dedicated stick]. As a new type of smoking article, a product having a smoking form similar to those of general smoking articles is being developed by applying a carbon-based heat source to the tip of the smoking article. Accordingly, the present disclosure has attempted to develop a combustible heat source that can have a smoking form (ignition, smoking start point) similar to those of the general smoking articles.

Existing combustible heat sources, mainly including charcoal, are not easy to ignite, and there has been a limitation in that the shape of the heat source is broken due to the excessively high speed of combustion after igniting. In order to ignite the combustible heat source and to proceed with stable combustion at the same time, the conventional heat source used calcium carbonate as a combustion inhibitor and used a binder component or the like in order to maintain the shape of the heat source, but there was also a problem in that the amount of smoke generated was large, and the ignitability were insufficient.

Therefore, the present disclosure is intended to propose a combustible heat source composition having excellent ignitability and combustion persistency, and a combustible heat source-applied smoking article comprising the combustible heat source composition.

Therefore, the present disclosure provides a combustible heat source composition for a smoking article, that does not contain a binder and a combustion inhibitor, wherein a polyhydric alcohol is contained in an amount of 1 to 5 parts by weight based on 100 parts by weight of the solid content of the composition.

In addition, the present disclosure may provide a combustible heat source-applied smoking article composed of the above composition.

Hereinafter, the present disclosure will be described in more detail.

The combustible heat source composition according to the present disclosure does not comprise a binder and a combustion inhibitor, and is used by adding a polyhydric alcohol instead of the binder or combustion inhibitor. The heat source composition according to the present disclosure is characterized in that easy ignition and stable combustion persistence are possible by comprising a polyhydric alcohol.

In the present disclosure, a polyhydric alcohol is added to the composition and used. The polyhydric alcohol is added, and thus combustible vaporization is possible after ignition of the heat source, thereby enabling ignition and combustion persistency to be improved. The polyhydric alcohol assists combustion and may be glycerin or propylene glycol.

The glycerin is a material used during manufacturing smoking articles, and has a high flash point and can secure safety during use. While glycerin was used, combustible steam was provided to the heat source during combustion to exhibit an effect of promoting initial combustion, but it was also confirmed that off-flavor and smoke were generated during combustion. Therefore, in the present disclosure, it was possible to confirm improvements by applying propylene glycol, which is similar to glycerin and has a low boiling point (※ glycerol boiling point 290° C./propylene glycol boiling point 188.2° C.).

The polyhydric alcohol may be used in an amount of 1 to 5 parts by weight based on 100 parts by weight of the solid content. It has excellent ignitability and combustion persistency within the above range, and more preferably, when used in an amount of 1 to 3 parts by weight, rapid ignition and stable combustion proceeding are possible.

The heat source according to the present disclosure is characterized in that it does not comprise a binder component or a combustion inhibitor. The binder may be carboxymethylcellulose, ammonium alginate, pectin, carrageenan, guar gum, or the like. Since the binder is used to maintain the shape of the heat source but may generate smoke during combustion, it was possible in the present disclosure to enable the shape of the heat source as well as the combustion persistency of the heat source to be maintained by utilizing a polyhydric alcohol without containing the above component in the heat source.

In addition, the combustion inhibitor may be calcium carbonate, and since the combustion inhibitor affects the combustion persistency of the combustion body and should be used in a relatively large amount, a heat source having excellent ignitability and combustion persistency is manufactured by utilizing an ignition accelerator in the present disclosure. Potassium nitrate, sugar, etc. may be used as the ignition accelerator.

More specifically, the composition may comprise 1 to 10% by weight of graphite, 5 to 12% by weight of potassium nitrate, 1 to 9% by weight of sugar, 5 to 10% by weight of aluminum powder, and the balance of charcoal.

The charcoal is used as a fuel that is ignited as a main material of a heat source and maintains combustion. The charcoal is preferably contained in an amount of 50% by weight or more based on 100% by weight of the solid content, and may maintain a temperature necessary for smoking for 3 minutes or more by being contained in an amount of 50% by weight or more.

The graphite increases the density of the heat source and may help to maintain combustion. The graphite may be contained in an amount of 1 to 10% by weight, and if it is contained in an amount of less than 1% by weight, the combustion persistency may be reduced due to insufficient density of the heat source, and if it is contained in an amount of more than 10% by weight, the density may become high and thus affect ignitability.

The potassium nitrate is used as a combustion improver, and sugar is used as a complexing aid. 5 to 12% by weight of potassium nitrate and 1 to 9% by weight of sugar are used, and it is preferable in terms of ignitability and smoke generation to contain potassium nitrate and sugar in an amount of 20% by weight or less based on the total weight.

The sugar is a sugar alcohol, and sorbitol, xylitol, mannitol, maltitol, lactitol, erythritol, reduced palatinose, or reduced starch syrup may be used. Preferably, mannitol with low hygroscopicity is suitably used in the heat source.

The aluminum has an effect on the temperature of the combustion body, and is used in an amount of 5 to 15% by weight, and thus the smoking article to which a heat source is applied may have a suitable temperature during smoking. When the aluminum is used in an amount of less than 5% by weight, the ability to maintain the temperature of the heat source may be reduced, and when it is used in an amount exceeding 15% by weight, ignitability may be affected.

The heat source may be ignited within 30 seconds, and combustion may last for 140 seconds or longer. The heat source having the ignition time and the combustion time may have a diameter of 5 to 10 mm and a length of 8 to 15 nm, but is not limited thereto.

According to one embodiment of the present disclosure, the combustible heat source is formed by mixing the composition and forming the mixture in advance into a desired shape. It may be pre-formed into a desired shape using any suitable known ceramic forming methods, for example, slip casting, extrusion molding, injection molding, mold compression, or pressurization.

Preferably, the combustible heat source is formed by a pressurization process or an extrusion process. Most preferably, the combustible heat source is formed by a pressurization process.

Preferably, the combustible heat source may have an apparent density between about 0.8 g/cm$^3$ and about 3.0 g/cm$^3$, preferably, the combustible heat source may have a mass between about 300 mg and about 500 mg, more preferably about 400 mg and about 450 mg.

The combustible heat source may be a circular cross-sectional cylindrical or tapered cylindrical form or a substantially elliptical cross-sectional cylindrical or tapered cylindrical form, but is not limited thereto.

Accordingly, the present disclosure may provide a smoking article to which the heat source is applied.

The "smoking article" may mean any smokeable product or any product that can provide a smoking experience regardless of whether or not it is based on tobacco, tobacco derivatives, expanded tobacco, reconstituted tobacco, or tobacco substitutes. For example, the smoking article may mean a smokeable article capable of generating an aerosol, such as a cigarette, cigar, cigarillo, or the like.

The smoking article may comprise a combustible heat source composed of the composition, a medium part, a thermally conductive wrapper, cigarette paper, a cooling part, a filter part, etc., and the combustible heat source: the medium part: the cooling part; and the filter part may be aligned in order based on the longitudinal direction, but the order can be freely changed except for the case where the combustible heat source is located upstream. In addition to this, additional configurations may be further included or one or more of the above-described configurations may be omitted. The smoking article may have a diameter of, for example, 4 mm to 10 mm, and a circumference of 14 mm to 29 mm. In addition, the smoking article may have a length of 45 mm to 100 mm.

The medium part may include, for example, at least one of cut tobacco, cut reconstituted tobacco leaves, smoking article leaves, expanded smoking article, and nicotine extract. The medium part may contain a nicotine component. In addition to the medium part, an aerosol-generating material may be further contained. The aerosol-generating material may include polyhydric alcohols, esters of polyhydric alcohols such as glycerol mono-, di- or triacetate, and aliphatic esters of mono-, di- or esters of polycarboxylic acids such as dimethyl dodecanedioate and dimethyl tetradecanedioate. More specifically, the aerosol-generating material may include, for example, at least one of glycerin, propylene glycol, ethylene glycol, dipropylene glycol, diethylene glycol, triethylene glycol, tetraethylene glycol, and oleyl alcohol. For example, the medium part may include cut reconstituted tobacco leaves immersed in glycerin. However, this is an example and the present disclosure is not necessarily limited to the description described above.

The medium part may have a length between about 5 mm and about 20 mm, more preferably between about 8 mm and about 12 mm. The medium part is surrounded by paper or other wrapper and may be in the form of a plug or part containing a material capable of releasing volatile compounds in response to heating. As described above, when the medium part is in the form of a plug or part, the entire plug or part including any wrapper is considered to be the medium part.

The cooling part may contain a cooling material. The cooling part includes a tubular hollow body with an open end, and may cool airflow passing through the heat source and the medium part. The cooling part may be made of a polymer material or a biodegradable polymer material and may have a cooling function. For example, the cooling part may be paper, cardboard, plastic, and may be, for example, cellulose acetate, ceramic, and a combination thereof. Additionally, the cooling part may include a corrugated sheet of material selected from the group consisting of metal foil, polymeric material, and substantially non-porous paper or cardboard. In certain embodiments, the aerosol cooling element may also include a corrugated sheet of material selected from the group consisting of polyethylene (PE), polypropylene (PP), polyvinyl chloride (PVC), polyethylene terephthalate (PET), polylactic acid (PLA), cellulose acetate (CA), and aluminum foil. The cooling part may have a length between about 5 mm and about 30 mm, more preferably between about 8 mm and about 25 mm, but the length may be freely adjusted in consideration of the temperature of heat generated from a heatable heat source.

The filter part contains a filter material, and the shape of the filter part is not limited. For example, the filter part may be a cylinder-type rod or a tube-type rod including a hollow therein. Alternatively, the filter part may be a recess-type rod. If the filter part is composed of a plurality of segments, at least one of the plurality of segments may be manufactured in a different shape. For example, the filter part may include a fibrous phase, a filament phase, or a filter tow including both thereof, containing at least one of polymer, paper, cellulose acetate, activated carbon, and carbon, but is not limited thereto. The filter part, for example, may have a length of 5 to 20 mm.

In addition to this, the filter may further comprise a tipping paper in contact with the mouth, which surrounds the filter material. The tipping paper may have one or more perforations formed therein.

The filter part may be manufactured to generate flavor. As an example, a flavoring liquid may be sprayed onto the filter material, and a separate fiber coated with the flavoring liquid may be inserted into the filter part.

The cooling part and the filter part may contain an aerosol modifier. For example, one or more of the cooling part, filter part, and tipping paper of the smoking article according to the present disclosure may contain one or more aerosol modifiers. Suitable aerosol modifiers may not be limited thereto, but may include a flavoring agent and a chemesthetic agent. The flavoring agent is used to describe any substance that, when used, imparts taste, aroma, or both thereof to aerosols generated by a tobacco material and an aerosol-generating material of the smoking article.

In addition, the cigarette paper is composed of cellulose fibers obtained from wood, flax, or other materials, and may be wrapped around a medium part, wrapped around the entire smoking article comprising the medium part, or wrapped around a part except for the filter part. The base paper of the cigarette paper may have a thickness of about 30 μm to about 100 μm, and the base paper may have a basis weight of about 15 g/m$^2$ to about 80 g/m$^2$.

The smoking article according to the present disclosure may also comprise downstream one or more aerosol modifiers that are both a flavoring agent and a chemesthetic agent. For example, one or more of the cooling part and filter part of the smoking article according to the present disclosure may contain menthol or another flavoring agent that provides a cooling object sensory effect.

In addition, the smoking article comprising the combustible heat source may comprise a thermally conductive wrapper surrounding the combustible heat source and the medium part. The thermally conductive wrapper may completely surround the heat source and the medium part, partially surround a portion of the heat source and the medium part, or entirely surround a portion of the heat source and the medium part. The thermally conductive wrapper transfers heat generated from a combustible heat source to the tobacco material, and the wrapper may include metal foil wrappers such as an aluminum foil wrapper, a steel wrapper, an iron foil wrapper, and a copper foil wrapper; and metal alloy foil wrappers, and is not limited to the material as long as it is a material capable of efficiently transferring heat.

A metal barrier may be formed between the heatable heat source and the medium part. Here, the metal barrier may prevent direct contact of a combustible heat source part with the medium part, and may prevent some out of components generated in the combustible heat source part from moving to the medium part.

The thickness of the barrier may be appropriately adjusted to obtain good smoking performance. In a specific embodiment, the barrier may have a thickness between about 10 microns and about 500 microns. The barrier may include one or more metallic materials that are substantially thermally stable and non-combustible at the temperatures obtained by the combustible heat source upon ignition and combustion. Suitable materials are known in the art and are not limited thereto, but they include aluminum, copper, stainless steel, and combinations thereof.

Hereinafter, Embodiments will be described in detail with reference to the accompanying drawings. However, since various changes can be made to the Embodiments, the scope of rights of the patent application is not restricted or limited by these Embodiments. It should be understood that all changes, equivalents or substitutes to the Embodiments are included within the scope of rights.

Terms used in the Embodiments are used only for descriptive purposes and should not be construed as an intention of limiting the present disclosure. Singular expressions include plural expressions unless the context clearly dictates otherwise. In this specification, terms such as "include" or "have" are intended to designate that there is a feature, number, step, operation, component, part, or combination thereof described in the specification, but it should be understood that the presence or addition of one or more other features, numbers, steps, operations, components, parts, or combinations thereof is not precluded.

Unless defined otherwise, all terms used herein, including technical or scientific terms, have the same meaning as commonly understood by a person of ordinary skill in the art to which the Embodiments belong. Terms such as those defined in commonly used dictionaries should be interpreted as having a meaning consistent with the meaning in the context of the related art, and unless explicitly defined in the present application, they should not be interpreted in an ideal or excessively formal meaning.

In addition, in the description with reference to the accompanying drawings, the same reference numerals are given to the same components regardless of reference numerals, and overlapping descriptions thereof will be omitted. In describing Embodiments, if it is determined that a detailed description of a related known technology may unnecessarily obscure the gist of the Embodiments, the detailed description will be omitted.

Embodiment

1. Manufacture of Combustible Heat Sources

According to the compositions shown in Table 1 below; combustible heat source compositions comprising charcoal, graphite, aluminum, potassium nitrate, and sugar were prepared. The heat sources were manufactured in the form of a cylinder with a diameter of 7 mm and a height of about 11 mm. Materials for manufacturing heat sources were prepared according to the mixing ratios and then mixed using an atmospheric pressure mixer (ARE-310 from THINKY). When mixing, each material was mixed at 1500 RPM for 1 minute each time it was added.

The mixed powders were mixed at 1500 RPM for 5 minutes by adding appropriate amounts of moisture or oil in parts by weight presented in Table 1. The mixed samples were divided into about 0.6 g and pressed through a press to form pressed samples in a cylinder shape.

The pressed samples were dried at 80° C. for 30 minutes through TGA (TGA791 from LECO).

TABLE 1

| | Solid mixing ratio (%, weight basis) | | | | | | | | Oil and moisture content (parts by weight) | | |
|---|---|---|---|---|---|---|---|---|---|---|---|
| | Charcoal | Graphite | CMC | Al | $CaCO_3$ | $KNO_3$ | Sugar | Sum | Moisture | Glycerin | PG |
| Embodiment 1 | Balance | 0 | 5 | 7.5 | 0 | 7.5 | 5 | 100 | 0 | 1 | 0 |
| Embodiment 2 | Balance | 0 | 5 | 7.5 | 0 | 7.5 | 5 | 100 | 0 | 0 | 1 |
| Embodiment 3 | Balance | 0 | 5 | 7.5 | 0 | 7.5 | 5 | 100 | 0 | 2 | 0 |
| Embodiment 4 | Balance | 0 | 5 | 7.5 | 0 | 7.5 | 5 | 100 | 0 | 0 | 2 |
| Embodiment 5 | Balance | 0 | 5 | 7.5 | 0 | 7.5 | 5 | 100 | 0 | 3 | 0 |
| Embodiment 6 | Balance | 0 | 5 | 7.5 | 0 | 7.5 | 5 | 100 | 0 | 0 | 3 |
| Embodiment 7 | Balance | 0 | 5 | 7.5 | 0 | 7.5 | 5 | 100 | 0 | 4 | 0 |
| Embodiment 8 | Balance | 0 | 5 | 7.5 | 0 | 7.5 | 5 | 100 | 0 | 0 | 4 |
| Embodiment 9 | Balance | 0 | 5 | 7.5 | 0 | 7.5 | 5 | 100 | 0 | 5 | 0 |
| Embodiment 10 | Balance | 0 | 5 | 7.5 | 0 | 7.5 | 5 | 100 | 0 | 0 | 5 |
| Comparative Embodiment 1 | Balance | 5 | 0 | 7.5 | 0 | 7.5 | 5 | 100 | 1 | 0 | 0 |
| Comparative Embodiment 2 | Balance | 5 | 0 | 7.5 | 0 | 7.5 | 5 | 100 | 2 | 0 | 0 |
| Comparative Embodiment 3 | Balance | 5 | 5 | 7.5 | 0 | 7.5 | 5 | 100 | 0 | 2 | 0 |
| Comparative Embodiment 4 | Balance | 5 | 10 | 7.5 | 0 | 7.5 | 5 | 100 | 0 | 0 | 2 |
| Comparative Embodiment 5 | Balance | 5 | 0 | 7.5 | 30 | 7.5 | 5 | 100 | 0 | 0 | 2 |
| Comparative Embodiment 6 | Balance | 5 | 0 | 7.5 | 40 | 7.5 | 5 | 100 | 0 | 0 | 2 |

TABLE 1-continued

| | Solid mixing ratio (%, weight basis) | | | | | | | | Oil and moisture content (parts by weight) | | |
|---|---|---|---|---|---|---|---|---|---|---|---|
| | Charcoal | Graphite | CMC | Al | $CaCO_3$ | $KNO_3$ | Sugar | Sum | Moisture | Glycerin | PG |
| Comparative Embodiment 7 | Balance | 5 | 10 | 7.5 | 30 | 7.5 | 5 | 100 | 0 | 0 | 2 |
| Comparative Embodiment 8 | Balance | 5 | 0 | 7.5 | 0 | 7.5 | 5 | 100 | 0 | 0 | 7 |
| Comparative Embodiment 9 | Balance | 5 | 0 | 7.5 | 0 | 7.5 | 5 | 100 | 0 | 0 | 8 |

2. Confirmation of Combustion Results of Combustible Heat Sources

The manufactured heat sources were ignited and then burned to show the observation results in Table 2 below.

TABLE 2

| | Ignitability | Combustion maintenance/ surface combustion speed | Shape maintenance after combustion |
|---|---|---|---|
| Embodiment 1 | ○ Combustion started in 27 s | Surface combustion (takes 180 s) | ○(Smell of burning charcoal) Large amount of smoke generation |
| Embodiment 2 | ○ Combustion started in 26 s | Surface combustion (takes 165 s) | ○ |
| Embodiment 3 | ○ Combustion started in 25 s | Surface combustion (takes 174 s) | ○(Smell of burning charcoal) Large amount of smoke generation |
| Embodiment 4 | ○ Combustion started in 25 s | Surface combustion (takes 148 s) | ○ |
| Embodiment 5 | ○ Combustion started in 27 s | Surface combustion (takes 172 s) | ○(Smell of burning charcoal) Large amount of smoke generation |
| Embodiment 6 | ○ Combustion started in 23 s | Surface combustion (takes 143 s) | ○ Surface blue flame generation |
| Embodiment 7 | ○ Combustion started in 23 s | Surface combustion (takes 160 s) | ○(Smell of burning charcoal) Large amount of smoke generation |
| Embodiment 8 | ○ Combustion started in 24 s | Surface combustion (takes 142 s) | ○ |
| Embodiment 9 | ○ Combustion started in 24 s | Surface combustion (takes 150 s) | ○(Smell of burning charcoal) Large amount of smoke generation |
| Embodiment 10 | ○ Combustion started in 21 s | Surface combustion (takes 141 s) | |
| Comparative Embodiment 1 | Δ Combustion started in 40 s | Δ Combustion stop | X |
| Comparative Embodiment 2 | X Ignition failure | X Ignition failure | X |
| Comparative Embodiment 3 | Δ Combustion started in 64 s | Δ Large amount of smoke generation | X |
| Comparative Embodiment 4 | Δ Combustion started in 52 s | Δ Large amount of smoke generation | X |
| Comparative Embodiment 5 | Δ Combustion started in 34 s Breakage occurrence | Δ Large amounts of smoke/flame generation | X |
| Comparative Embodiment 6 | Δ Combustion started in 36 s Breakage occurrence | Δ Large amounts of smoke/flame generation, Heat source inflates | X |
| Comparative Embodiment 7 | Δ Combustion started in 31 s | Δ Severe smoke generation | X |
| Comparative Embodiment 8 | Δ Combustion started in 18 s | Δ Large amounts of smoke/flame generation, Heat source inflates | X |
| Comparative Embodiment 9 | Δ Combustion started in 17 s | Δ Large amounts of smoke/flame generation, Heat source inflates | X |

As can be confirmed from the results of Table 2, in the case of having the compositions as in Embodiments 1 to 10, good ignitability and combustibility were confirmed. In particular, as shown in FIG. 1, good combustion results were shown when glycerin and propylene glycol were contained in an amount of 2% by weight. Embodiments 1 to 10 all showed good combustion results, but in the case of the heat sources using glycerin (Embodiments 1, 3, 5, 7, and 9), the smell of burning charcoal and smoke were generated.

In comparison, ignitability was reduced, and phenomena of stopping the combustion occurred in Comparative Embodiments 1 and 2 containing moisture.

In addition, in the case of Comparative Embodiments 3 and 4 containing CMC as a binder, combustion started slowly and a large amount of smoke was generated, and in the case of Comparative Embodiments 5 and 6 containing calcium carbonate, there were problems in that combustion started slowly and a large amount of smoke/flame was generated. In addition, also in the case of Comparative Embodiment 7 containing both the CMC and calcium carbonate, combustion started slowly and smoke was severely generated.

In addition, in the case of Comparative Embodiments 8 and 9 containing 7% by weight and 8% by weight of PG, as shown in FIG. 2, combustion started rapidly, but excessive smoke/flame was generated and phenomena in which the heat sources are inflated were confirmed.

Although the above-mentioned embodiments have been described by limited drawings, those skilled in the art may apply various technical modifications and alterations based on the above-mentioned description. For example, appropriate results can be achieved although described techniques are carried out in a different order from a described method, and/or described elements of a system, structure, apparatus, circuit, etc. are combined or mixed in a different form from the described method, or replaced or substituted with other elements or equivalents.

Therefore, other embodiments, other examples, and equivalents to patent claims belong to the scope of the patent claims to be described later.

The invention claimed is:

1. A combustible heat source composition for a smoking article, that does not contain a binder and a combustion inhibitor, wherein the composition comprises 1 to 5 parts by weight of a polyhydric alcohol based on 100 parts by weight of the composition, wherein the composition comprises potassium nitrate and sugar as ignition accelerator, and wherein the sugar is selected from the group consisting of sorbitol, xylitol, mannitol, maltitol, lactitol, erythritol, reduced palatinose, and reduced starch syrup.

2. The combustible heat source composition of claim 1, wherein the binder is one or more selected from the group consisting of carboxymethylcellulose, ammonium alginate, pectin, carrageenan, and guar gum, and the combustion inhibitor is calcium carbonate.

3. The combustible heat source composition of claim 1, wherein the polyhydric alcohol is contained in an amount of 1 to 3 parts by weight.

4. The combustible heat source composition of claim 1, wherein the polyhydric alcohol is glycerin or propylene glycol.

5. The combustible heat source composition of claim 4, wherein the polyhydric alcohol is propylene glycol.

6. The combustible heat source composition of claim 1, wherein the heat source is ignited within 30 seconds, and combustion continues for 140 seconds or more.

7. A smoking article comprising a combustible heat source composed of the composition of claim 1.

8. The combustible heat source composition of claim 1, further comprising one or more selected from the group consisting of graphite, aluminum powder, and charcoal.

* * * * *